US005975461A

United States Patent [19]

Ullrich

[11] Patent Number: 5,975,461

[45] Date of Patent: Nov. 2, 1999

[54] VANE CONTROL SYSTEM FOR A GUIDED MISSILE

[75] Inventor: Hans-Günter Ullrich, Höhenkirchen, Germany

[73] Assignee: LFK-Lenkflugkörpersysteme GmbH, München, Germany

[21] Appl. No.: 08/941,581

[22] Filed: Sep. 30, 1997

[30] Foreign Application Priority Data

Oct. 1, 1996 [DE] Germany ..... 196 40 540

[51] Int. Cl.[6] ..... F41G 7/00; F42B 10/00

[52] U.S. Cl. ..... 244/3.21; 244/3.24

[58] Field of Search ..... 244/3.21, 3.24, 244/3.25, 3.26, 3.27, 3.28, 3.29, 3.3

[56] References Cited

U.S. PATENT DOCUMENTS

| | | | |
|---|---|---|---|
| 4,029,270 | 6/1977 | Niemeier | 244/3.21 |
| 5,662,290 | 9/1997 | Voigt | 244/3.21 |
| 5,806,791 | 9/1998 | Hatalsky et al. | 244/3.24 |
| 5,829,715 | 11/1998 | Banks | 244/3.27 |

FOREIGN PATENT DOCUMENTS 38 27 590 2/1990 Germany .

*Primary Examiner*—Charles T. Jordan
*Assistant Examiner*—Theresa M. Wesson
*Attorney, Agent, or Firm*—McGlew and Tuttle, P.C.

[57] ABSTRACT

A vane control system (2) for a guided missile (1) with at least two vanes (3) has two toothed rings (7, 8), which are arranged in parallel to one another on both sides of the vane axes (18), are driven by pinions (15, 16) which are driven by electric motors and rotate continuously. Two drive gears (11, 17), which engage one of the toothed rings (7, 8) and rotate together with them such that they have opposite directions of rotation, are arranged on each vane axis (18). A clutch disk (19), which can be connected to one of the drive gears (11, 17), as a result of which the vanes (3) can be rotated in the desired direction, is arranged between the drive gears (11, 17). A brake (22) for fixing the vane axis (18) and an incremental transducer (23) for indicating the actual position of the vane are arranged on each vane axis (18).

7 Claims, 3 Drawing Sheets

VANE CONTROL SYSTEM FOR A GUIDED MISSILE

FIELD OF THE INVENTION

The present invention pertains to a vane control system for a guided missile with at least two vanes and with two toothed rings, which are arranged on both sides of a vane axes in parallel to one another around the fuselage of the missile and are driven by pinions driven by means of electric motors which can rotate continuously.

BACKGROUND OF THE INVENTION

Such a vane control system has been known from DE 38 27 590 C2. The toothed rings are mounted there in a rotor ring, which continuously performs a rotary movement around the longitudinal axis of the missile relative to the missile. The rotatable rotor ring is located in the front part of the missile between the tip of the missile and the engine part. There are difficulties in this arrangement for the mounting of the rotatable rotor ring and for the static strength of the missile. The arrangement of the vanes in the front area of the missile is also unfavorable for the flight stability.

Accommodating the vane control systems in the tail part is difficult in the case of missiles with an air-breathing solid rocket and two air inlet channels on the underside, because the contraction at the engine at the tail part is small due to the shape of the engine. The space between the cruise engine and the launching engine, which space is usually present and which could be used for the vane control systems, is eliminated. In addition, the space available at the intended fuselage station of the carrier airplane is very limited for a vane, so that a conventional vane control system cannot be considered at this point.

SUMMARY AND OBJECTS OF THE INVENTION

The primary object of the present invention is to design a vane control system of the above-described type such that it can be integrated in the space available at the tail of the missile.

According to the invention, a vane control system for a guided missile with at least two vanes and with two toothed rings, which are arranged on both sides of the vane axes in parallel to one another around the fuselage of the missile, are driven by pinions driven by means of electric motors. The motors may rotate continuously. Two drive gears are provided, each engaging one of two toothed rings. The drive gears rotate together with the toothed rings such that the drive gears have opposite directions of rotation. The drive gears are attached freely rotating to a vane axis. A clutch disk is provided which can be connected to one of the drive gears, as a result of which the vanes can be rotated in the desired direction. The clutch disk is arranged between the drive gears.

The present invention makes it possible to arrange the vane control system at the rear end of the missile, where sufficient material is present due to the contraction of the nozzle of the engine. The two toothed rings with the drive gears engaging them may rotate continuously, without the missile itself or a part of the missile having to rotate. By means of the coupling located between the two drive gears rotating in opposite directions of rotation, it is possible to set any necessary vane position rapidly and accurately.

Further advantages will appear from the exemplary embodiment of the present invention shown in the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
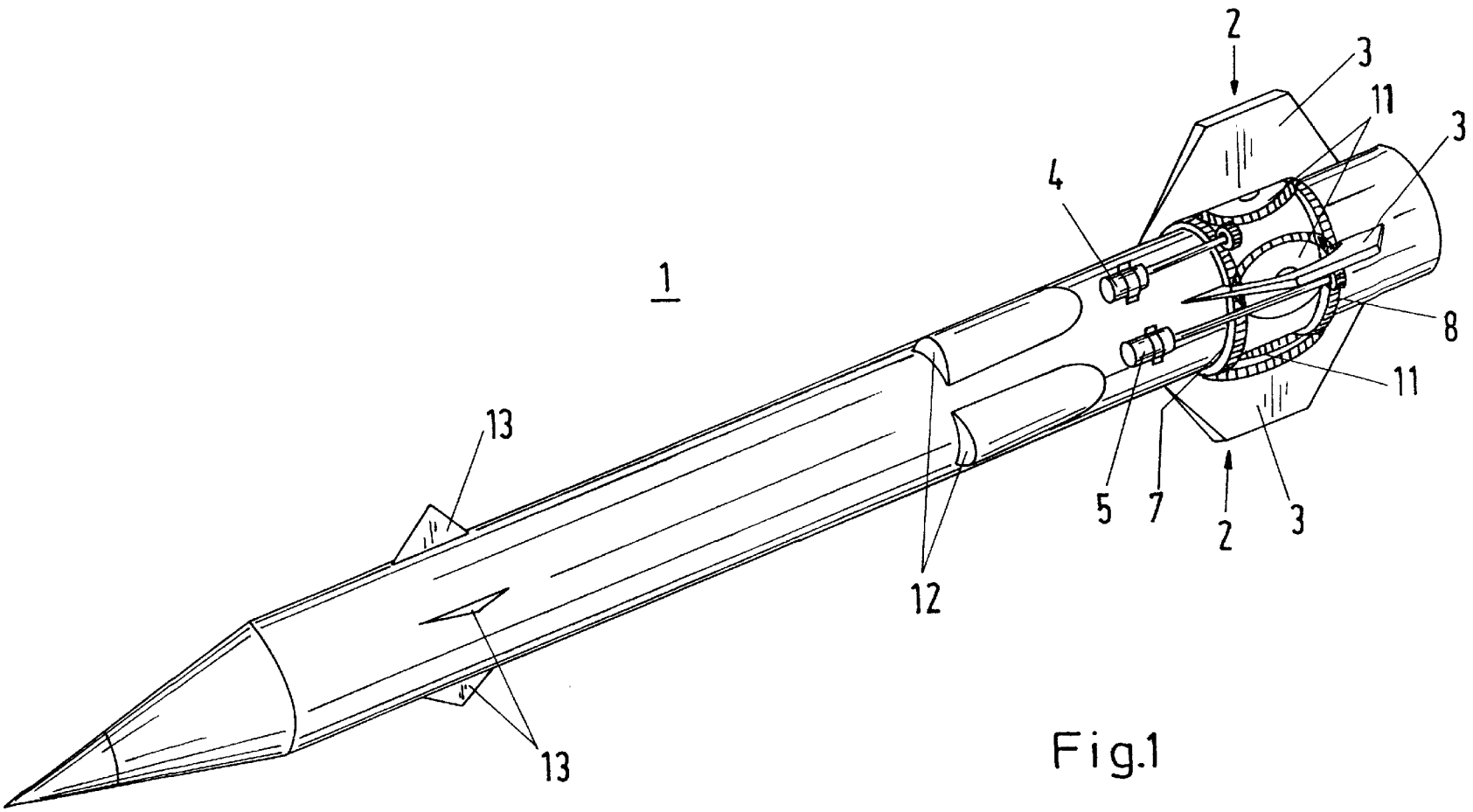
FIG. 1 is a perspective view of a missile with an air-breathing engine and four vanes according to the invention.

Referring to the drawings in particular, the invention comprises a guided missile vane control system. FIG. 1 shows a guided missile 1 with an airframe or fuselage with a vane control system 2 in its tail structure instead of a fuselage contraction. It comprises essentially four vane blades 3, which are offset by 90° and can be actuated via electric motors 4 and 5, toothed rings 7 and 8 as well as four drive gears 11. Two air intakes 12 as well as flow flaps 13 can be seen as well.

Figure 2:
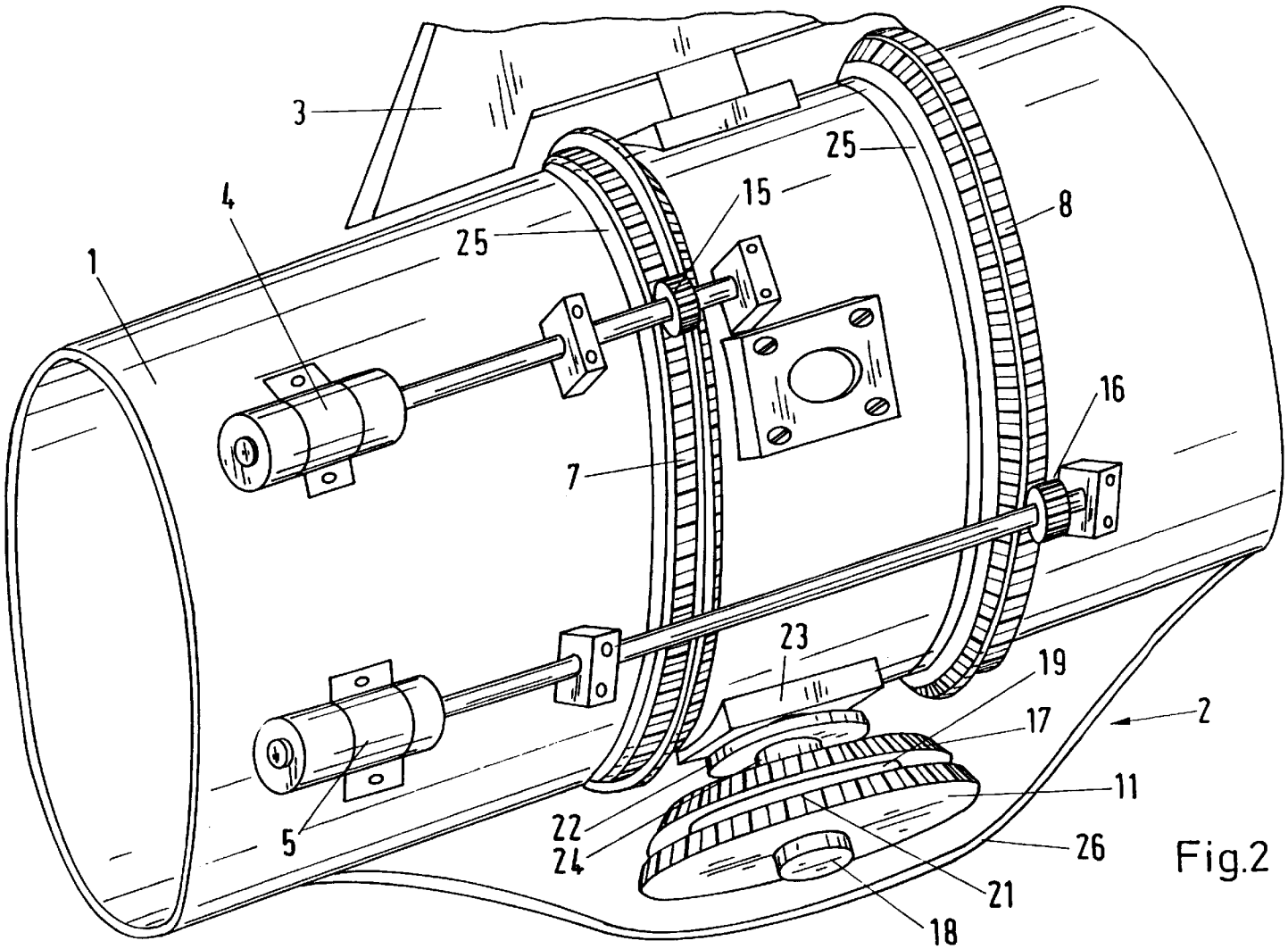
FIG. 2 is the rear part of the missile according to FIG. 1, wherein the vane control system for a vane is shown in an exploded view.

FIG. 2 shows schematically the exploded view of the vane control system 2 for a vane 3. The toothed rings 7 and 8 running on needle bearings are driven by pinions 15 and 16 in the same direction of rotation. A drive gear 17 and 11 is associated with each toothed ring 7 and 8, so that the toothed ring 7 consequently cooperates with the drive gear 17 and the toothed ring 8, with the drive gear 11. As a result, the drive gears 17 and 11 are freely movable in opposite directions of rotation on a vane axis 18. A clutch disk 19, which is provided with a drive unit, not shown, is connected to the vane axis (pivot axle) 18 with tongue and groove 21 and can be optionally connected to the drive gears 11 and 17 in a nonpositive manner, as a result of which the vane 3 turns in the desired direction, is located between the drive gears 11 and 17. If no vane adjustment is requested during a calculable period of time or only fine steering is needed at high speeds, the drive gears 11 and 17 are uncoupled, and the vane axis 18 can be held in the current position by a brake 22. A fine control may be performed in this case in the known manner, e.g., by changing the external geometry of the vanes 3. An incremental transducer 23 arranged on the vane axis 18 shows the current position of the vane 3 in relation to its zero position defined during the launching of the missile 1 and it is also used as a signal transmitter for a steering control circuit. The zero position of the vane 3 is embodied by a bolt 24, which is severed at the start of the missile 1 by, e.g., a melting wire. Changes in the diameter and shape of the engine pipe due to thermal effects are absorbed by rings 25, which are arranged between the engine pipe and the needle bearings of the toothed rings 7 and 8. The vane control system 2 as a whole is protected with an aerodynamically favorable cover 26.

Figure 3:
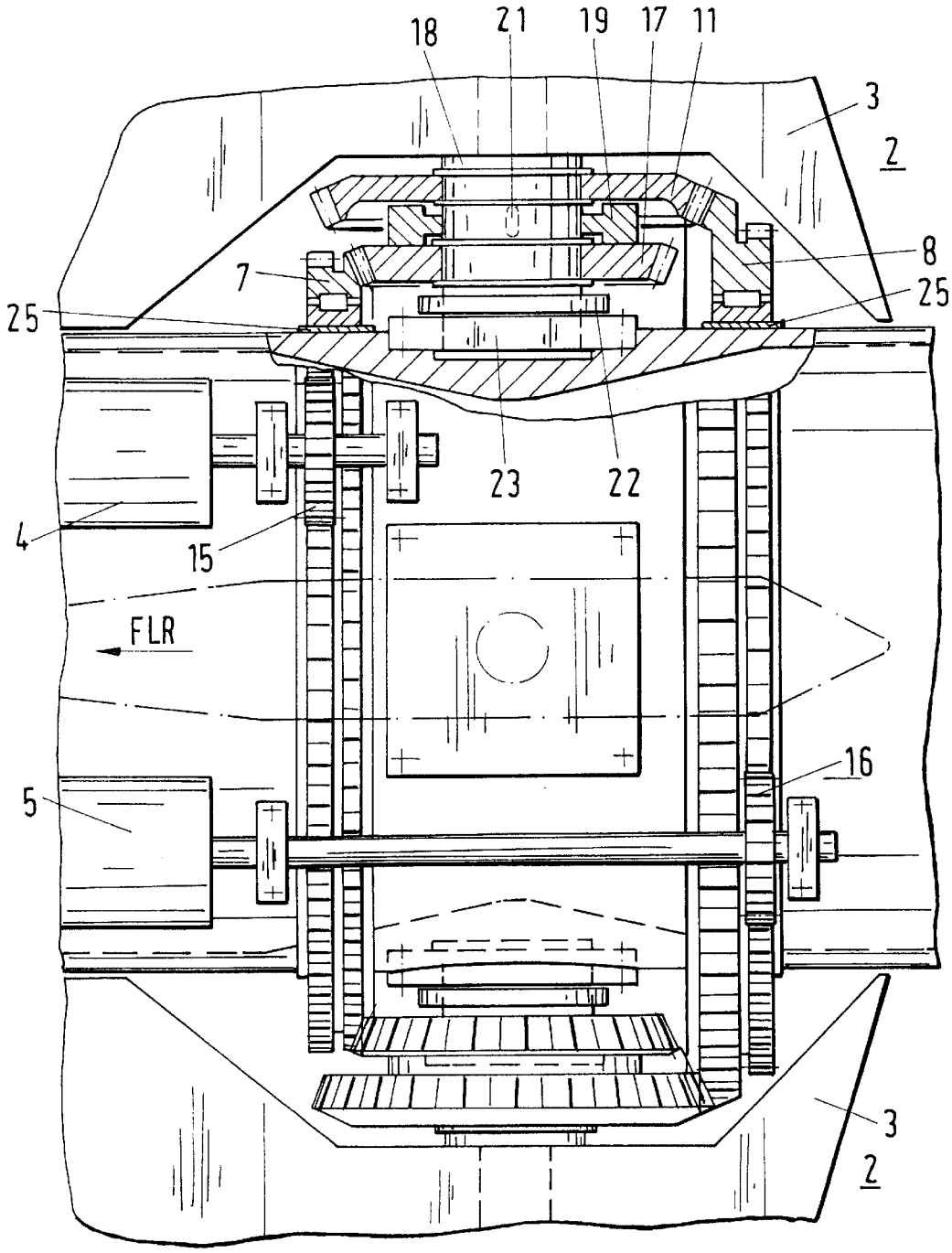
FIG. 3 is a longitudinal section through the missile part according to FIG. 2, which shows the parts of the vane control system for two opposite vanes.

The longitudinal section in FIG. 3 shows two of the four vane control systems 2. The mode of action of the vane control systems 2 can be understood especially easily from this figure, which shows nearly all the individual parts described on the basis of FIG. 2. It can be clearly seen that the drive gears 11 and 17 rotate in opposite directions of rotation with the toothed rings 7 and 8 rotating in the same direction, as a result of which they adjust the vanes 3 in opposite directions during coupling with the clutch disks 19.

While a specific embodiment of the invention has been shown and described in detail to illustrate the application of the principles of the invention, it will be understood that the invention may be embodied otherwise without departing from such principles.

What is claimed is:

1. A missile vane control system, comprising:

a missile fuselage;

a vane connected to the missile fuselage, said vane having a vane axis;

another vane connected to the missile fuselage, said another vane having a vane axis;

a toothed ring arranged on one side of the vane axes;

another toothed ring arranged on another side of the vane axes, said toothed rings being in parallel to one another, said toothed rings being mounted for rotation about said missile fuselage;

a pinion connected to said toothed ring;

an electric motor connected to said pinion;

another pinion connected to said another toothed ring;

another electric motor connected to said another pinion;

a drive gear engaging said toothed ring to rotate together with said toothed ring;

another drive gear engaging said another toothed ring to rotate together with said another toothed ring, such that said toothed ring and said another toothed ring have opposite directions of rotation, said drive gear and said another drive gear being attached freely rotating to said vane axes;

a clutch disk arranged between said drive gear and said another drive gear, said clutch disk being connectable with said drive gear and said another drive gear for rotating said vane in a desired direction.

2. The missile vane control system according to claim 1, wherein said electric motors, said pinions, said toothed rings and said drive gears rotate continuously during missile flight.

3. The vane control system in accordance with claim 1, further comprising a brake fixing said vane axes in any desired position of said vane when said clutch disk is disengaged, said brake being arranged on said vane axis.

4. The vane control system in accordance with claim 1, further comprising an incremental transducer arranged on said vane axes, said incremental transducer indicating the actual position of said vanes; and a steering control circuit, said incremental transducer acting as a signal transmitter for said steering control circuit.

5. The vane control system in accordance with claim 1, further comprising bolt means for fixing said vanes in a zero position before launching of the missile and being severed at a start of the missile launch.

6. The vane control system in accordance with claim 1, wherein said toothed rings are supported on needle bearings.

7. The vane control system in accordance with claim 6, further comprising rings. formed of a material able to compensate temperature-dependent changes in a shape of an engine pipe of the fuselage, said rings being arranged between said engine pipe and said needle bearings supporting said toothed rings.

* * * * *